US007769139B2

(12) United States Patent
Sakabe

(10) Patent No.: US 7,769,139 B2
(45) Date of Patent: Aug. 3, 2010

(54) X-RAY GENERATING METHOD, AND X-RAY GENERATING APPARATUS

(75) Inventor: Noriyoshi Sakabe, 37-3-101 Kasuga 2-chome, Tsukuba-shi, Ibaraki (JP) 305-0821

(73) Assignees: Noriyoshi Sakabe, Tsukuba-Shi (JP); Kiwako Sakabe, Tsukuba-Shi (JP)

( * ) Notice: Subject to any disclaimer, the term of this patent is extended or adjusted under 35 U.S.C. 154(b) by 0 days.

(21) Appl. No.: 12/461,251

(22) Filed: Aug. 5, 2009

(65) Prior Publication Data

US 2010/0080359 A1 Apr. 1, 2010

(30) Foreign Application Priority Data

Sep. 29, 2008 (JP) ..... 2008-250490

(51) Int. Cl.
*H01J 35/20* (2006.01)

(52) U.S. Cl. ..... 378/123; 378/125; 378/144

(58) Field of Classification Search ..... 378/119–144
See application file for complete search history.

(56) References Cited

FOREIGN PATENT DOCUMENTS

JP A-2004-172135 6/2004

*Primary Examiner*—Courtney Thomas
(74) *Attorney, Agent, or Firm*—Oliff & Berridge PLC

(57) ABSTRACT

An energy beam is irradiated onto a rotating anticathode so as to heat a portion irradiated by the energy beam under the condition that a vapor pressure at equilibrium state of the portion is set to 0.1 Torr or more, thereby generating an X-ray. The portion irradiated by the energy beam is kept at the rotating anticathode by a centrifugal force to the portion it a direction outward from a surface of the portion.

12 Claims, 3 Drawing Sheets

X-RAY GENERATING METHOD, AND X-RAY GENERATING APPARATUS

CROSS-REFERENCE TO RELATED APPLICATIONS

This application is based upon and claims the benefit of priority from the prior Japanese Patent Application No. 2008-250490, filed on Sep. 29, 2008; the entire contents of which are incorporated herein by reference.

BACKGROUND OF THE INVENTION

1. Field of the Invention

This invention relates to a method for generating an X-ray with ultrahigh brightness and to an apparatus for generating the same X-ray.

2. Description of the Related Art

In the X-ray diffraction measurement or the like, it is often required that an X-ray with an intensity as high as possible is irradiated onto a sample so as to realize the X-ray diffraction measurement. As such an X-ray generating apparatus as being employed for the X-ray diffraction measurement, an X-ray generating apparatus of rotating anticathode target is conventionally well known.

The rotating anticathode X-ray generating apparatus is configured such that an electron beam is irradiated onto the outer surface of the columnar anticathode target while the columnar anticathode target is rotated under the condition that a cooling medium is flowed in the columnar anticathode target. The rotating anticathode X-ray generating apparatus has an extreme high cooling efficiency because the irradiating portion of the electron beam is varied with time in comparison with an X-ray generating apparatus of stationary target. Therefore, an electron beam can be irradiated onto the anticathode target under the condition of large current to generate an X-ray with high intensity (ultrahigh brightness).

By the way, the output power of an X-ray is generally dependent on an electric power (current×voltage) to be applied between a cathode and an anticathode. On the other hand, since the brightness of the X-ray is defined as (electric power)/(electron beam area on target), the maxi mum electric power is dependent on the electron beam area on a target. Namely, in order to increase the brightness of the X-ray, the electric power is increased while the electron beam area on the target is decreased.

In this case, however, since the intensity of the electron beam is increased per target unit area, the target may be melted and splashed by the electron beam irradiation. Therefore, the brightness of the X-ray can be increased theoretically on the basis of the above-described equation, but can not be increased practically on the basis of the melting point of the target. In this point of view, the brightness of the X-ray is restricted on the melting point of the target.

In this point of view, such an attempt is made in Reference 1 as irradiating an electron beam onto the inner side of the cylindrical portion of the rotating anticathode X-ray generating apparatus so as to heat the irradiating portion to a temperature equal to or near the melting point of the anticathode target. Here, a central axis is set for the rotating anticathode X-ray generating apparatus so that the cylindrical portion can be rotated around the central axis. In this case, since the electron beam irradiating portion is heated to a temperature around the melting point of the anticathode target, the electron beam irradiating portion is at least partially melted. However, since the electron beam irradiating portion is kept against the cylindrical portion by the centrifugal force generated by the rotation of the rotating anticathode target, the partially melted portion, originated from the electron beam irradiation, cannot be splashed outward from the cylindrical portion.

According to Reference 1, therefore, since the intensity of the electron beam to be irradiated onto the rotating anticathode target can be increased per target unit area under the condition that the melting and splashing of the rotating anticathode target are prevented, an X-ray with an relatively higher brightness can be obtained as compared with a conventional one.

[Reference 1] JP-A 2004-172135 (KOKAI)

In view of high resolution analysis, examination and medical application, however, it is required to increase the brightness of the X-ray and thus, develop an X-ray generating method and an X-ray generating apparatus so as to satisfy the above-described requirement.

BRIEF SUMMARY OF THE INVENTION

It is an object of the present invention to provide a new X-ray generating method and apparatus which can generate an X-ray with high brightness.

In order to achieve the object, the present invention relates to a method for generating an X-ray, comprising the steps of: irradiating an energy beam onto a rotating anticathode so as to heat a portion irradiated by the energy beam under the condition that a vapor pressure at equilibrium state of the portion is set to 0.1 Torr or more, thereby generating an X-ray; and affecting a centrifugal force to the portion in a direction outward from a surface of the portion so as to keep the portion at the rotating anticathode.

The present invention also relates to an apparatus for generating an x-ray, comprising: an energy beam source for generating an energy beam; a rotating anticathode for generating an x-ray by an irradiation of the energy beam from the energy beam; and a rotation mechanism, connected with the rotating anticathode, for affecting a centrifugal force in a direction outward from the rotating anticathode, wherein the energy beam is irradiated so as to heat a portion irradiated by the energy beam under the condition that a vapor pressure at equilibrium state of the portion is set to 0.1 Torr or more, wherein the portion is kept at the rotating anticathode by the centrifugal force.

In the present invention, the rotating anticathode target is employed so that an energy beam is irradiated onto the rotating anticathode target to generate an X-ray. In this case, the energy beam is controlled so that the vapor pressure of the rotating anticathode at equilibrium state can be set to 0.1 Torr or less. Therefore, the intended X-ray with high brightness can be generated for a long time while the consumption of the rotating anticathode is prevented. As of now, the reason why the intended X-ray with high brightness can be generated for a long time while the consumption of the rotating anticathode is prevented is not found out and clarified. However, the above-described effect/function is repeatedly confirmed through several experiments.

According to the present invention, the X-ray with a brightness three times or more as high as the X-ray generated according to Reference 1 can be generated.

In the present invention, "vapor pressure at equilibrium state" means a vapor pressure at thermal equilibrium state, and the definition of "0.1 Torr or more" is referred to "Vacuum handbook (Ulvac, Inc)" published by Ohmsha.

In an aspect of the present invention, the rotating anticathode includes a cylindrical portion with a central axis corresponding to a rotation center of the rotating anticathode so that the energy beam is irradiated onto an inner wall of the cylindrical portion. In this case, the irradiated portion by the energy beam can be easily and absolutely kept at the rotating anticathode.

In another aspect of the present invention, the energy beam is an electron beam. In this case, the intensity of the electron beam (energy beam) to be irradiated per target (rotating anticathode) unit area can be easily increased so as to easily generate an X-ray with high brightness.

As described above, according to the present invention can be provided the new X-ray generating method and apparatus which can generate an X-ray with high brightness.

BRIEF DESCRIPTION OF THE SEVERAL VIEWS OF THE DRAWINGS

For better understanding of the present invention, reference is made to the attached drawings.

DETAILED DESCRIPTION OF THE INVENTION

Hereinafter, the present invention will be described in detail with reference to the drawings.

Figure 1:
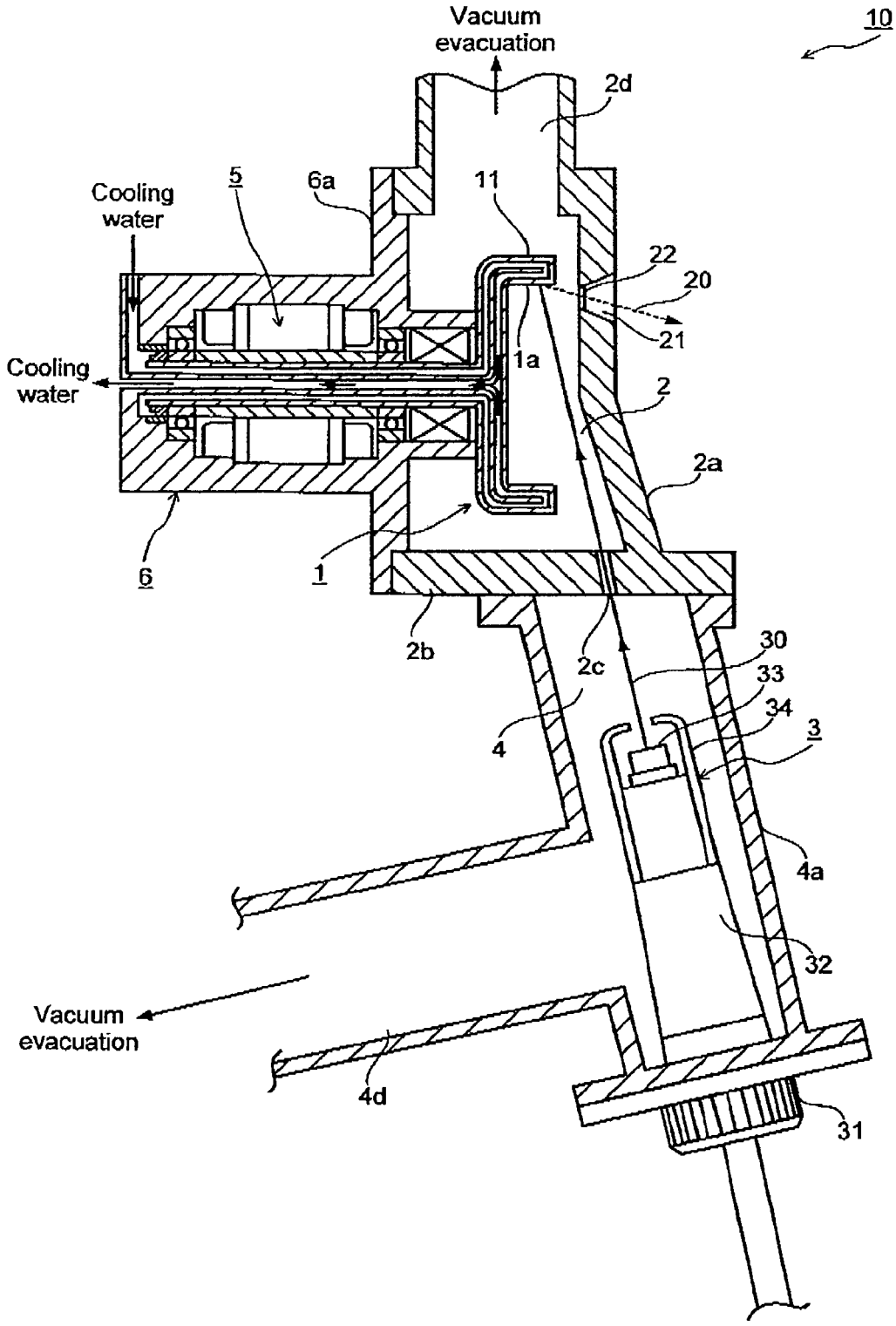
FIG. 1 is a structural view illustrating an X-ray generating apparatus according to an embodiment of the present invention.
Figure 2:
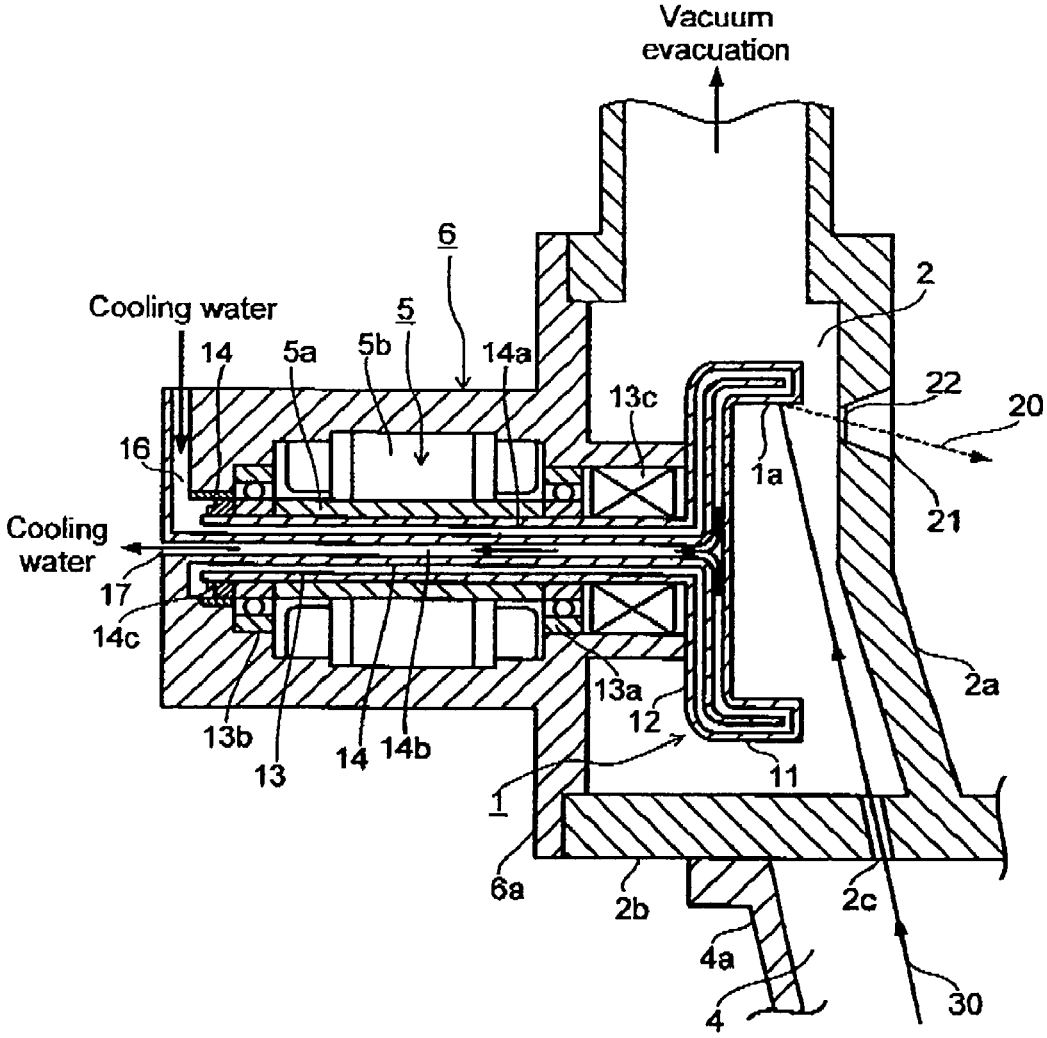
FIG. 2 is an enlarged view of the X-ray generating apparatus illustrated in FIG. 1.

FIG. 1 is a structural view illustrating an X-ray generating apparatus according to an embodiment of the present invention. FIG. 2 is an enlarged view of the X-ray generating apparatus illustrated in FIG. 1.

In FIGS. 1 and 2, the X-ray generating apparatus 10 includes an anticathode chamber 2 for accommodating a rotating anticathode 1, a cathode chamber 4 for accommodating a cathode 3 and a rotation driving chamber 6 for accommodating a driving motor 5 for rotating the anticathode 1 which are located in the vicinity of one another and separated from one another by air-tight members 2*a*, 4*a* and 6*a*. At a separating wall 2*b* for separating the anticathode chamber 2 and the cathode chamber 4 is formed a small hole 2*c* for passing electron beams 30 to be emitted from the cathode 3 through the separating wall 2*b*. Then, at the anticathode chamber 2 and the cathode chamber 4 are provided vacuum outlets 2*d* and 4*d*, respectively to which vacuum pumps (not shown) are connected.

The rotating anticathode 1 includes a cylindrical portion 11 made of Cu (copper)or the like, a circular plate 12 formed so as to close the one opening of the cylindrical portion 11, and a rotating shaft 13 with a center shaft shared with the cylindrical portion 11 and the circular plate 12 which are integrally formed. The interiors of the cylindrical portion 11, the circular plate 12 and the rotating shaft 13 are formed in air hole so that a cooling water can be flowed in the interiors thereof. An electron beam is irradiated onto the inner wall of the cylindrical portion 11 to form an electron beam irradiating portion 1*a* on the cylindrical portion 11.

The rotating shaft 13 is supported rotatably by a pair of bearings 13*a* and 13*b* which are provided in the rotation driving chamber 6. The rotor 5*b* of the driving motor 5 is provided at the periphery of the rotating shaft 13, and the stationary 5*a* to rotatably drive the rotor 5*b* is attached to the air-tight member 6*a* in the rotation driving chamber 6.

The rotating anticathode 1 is rotated by the rotation of the rotating shaft 13 so that a centrifugal force is generated outward from the rotating anticathode 1, that is, a cylindrical portion 11.

At the root of the rotating shaft 13 near the circular plate 12 is provided a rotating shaft-sealing member 13*c* for maintaining the interior of the anticathode chamber 2 in vacuum by arranging the rotating shaft 13 and the air-tight member 6*a* under air-tight condition.

In the rotating anticathode 1 is inserted a stationary separating member 14 for flowing the cooling water along the inner wall of the electron beam irradiating portion 1*a*. The stationary separating member 14 is formed in a cylindrical shape commensurate with the shape of the rotating shaft 13, enlarged along the shape of the circular shape 12 and elongated short of the inner wall of the cylindrical portion 11.

In other words, the stationary separating member 14 divides the interior space of the rotating anticathode 1 so as to be a double tube structure. The outer tube 14*a* of the double tube structure is communicated with a cooling water inlet 16. Herein, an axial sealing member 14*c* is provided at the left-side periphery of the rotating shaft 13 so that the cooling water, which is introduced from the inlet 16, is introduced into the outer tube 14*a* of the double tube structure so as not to be leaked to the accommodating space where the bearings 13*a*, 13*b* and the driving motor 5 are provided.

The cooling water, which is introduced from the inlet 16, is flowed in the outer tube 14*a* of the double tube structure, returned from the inner wall of the cylindrical portion 11 and flowed in the inner tube 14*b* of the double tube structure. In this case, the inner wall of the electron beam irradiating portion 1*a* is cooled by the cooling water, and the remnant cooling water is flowed in the inner tube 14*b* and discharged from the outlet 17.

At the air-tight member 2*a* in the vicinity of the electron beam irradiating portion 1*a* of the rotating anticathode 1 is provided an X-ray window 21 for taking out an X-ray 20 generated by the irradiation of the electron beam 30 onto the electron beam irradiating portion 1*a*. At the X-ray window 21 is provided an X-ray translucent film 22 made of a material which can pass the X-ray therethrough such as Be, Al so that the intended X-ray can be taken out of the apparatus with maintaining the vacuum condition of the anticathode chamber 2.

The cathode 3 includes an insulating structural portion 32, a filament 33, a wehnelt 34 and the like, and configured such that the electron beam 30 can be irradiated onto the rotating anticathode 1 by the supply of high voltage electric power with several ten kV from a high voltage electric power introducing portion 31 and the supply of filament electric power.

In such a state, the electron beam 30 is irradiated onto the electron beam irradiating portion 1*a* of the rotating anticathode 1 while the rotating anticathode 1 is rotated at high speed by the driving motor 5 under the condition that the cooling water is introduced into the inside of the rotating anticathode 1, that is, the cylindrical portion 11 to generate the X-ray 20.

In this embodiment, the vapor pressure at equilibrium state of the electron beam irradiating portion 1*a* of the cylindrical portion 11 of the rotating anticathode 1 is set to 0.1 Torr or more, preferably 100 Torr or less, more preferably 10 Torr or less when the electron beam 30 is irradiated onto the electron beam irradiating portion 1*a*. In this case, the intended X-ray with high brightness can be generated for a long time while the consumption of the rotating anticathode target is prevented. As of now, the reason why the intended X-ray with high brightness can be generated for a long time while the consumption of the rotating anticathode target is prevented is not found out and clarified.

If the vapor pressure at equilibrium state of the electron beam irradiating portion 1*a* is beyond 100 Torr which may be defined as an upper limited value of the vapor pressure thereat, the rotating anticathode 1 may be consumed remarkably so that the intended X-ray with high brightness may not be generated stably. If the vapor pressure at equilibrium state is set to around 10 Torr, the intended X-ray with high brightness can be generated for a long time while the consumption of the rotating anticathode target is prevented even though the rotating anticathode target is made of various materials.

Generally, the evaporation rate Γr of a material can be represented by the following equation (refer to "Vacuum Physics and Application" published by SHOKABO PUBLISHING Co., Ltd.);

$$\Gamma m = 5.8\times10^{-2}\times p\cdot(M/T)^{1/2}(\mathrm{g\cdot cm^{-2}\cdot sec^{-1}}) \quad (1)$$

(Herein, p: vapor pressure at equilibrium state (Torr), M: molecular weight, T; temperature (K)).

As one embodiment, if the rotating anticathode 1 is made of Cu, the temperature T is 2130 K when the vapor pressure p at equilibrium state is 10 Torr. Since the molecular weight M of Cu is 63.54, the evaporation rate m of Cu becomes 0.1 ($\mathrm{g\cdot m^{-2}\cdot sec^{-1}}$) according to the equation (1). On the other hand, since the area of the electron beam irradiating portion 1*a* is about 0.24 ($\mathrm{cm^2}$), for example, the evaporation amount per unit time becomes $2.4\times10^{-2}$ ($\mathrm{g\cdot sec^{-1}}$) on the basis of the multiplying calculation of 0.1 ($\mathrm{g\cdot cm^{-2}\cdot sec^{-1}}$)×0.24 ($\mathrm{cm^2}$). Namely, $2.4\times10^{-2}$ (g) of Cu is evaporated per second.

Since the density ρ of Cu is 8.92 ($\mathrm{g\cdot cm^{-3}}$), $2.7\times10^{-3}$ ($\mathrm{cm^3}$) of Cu is evaporated on the basis of the calculation of $2.4\times10^{-2}$ ($\mathrm{g\cdot sec^{-1}}$)/8.92 ($\mathrm{g\cdot cm^{-3}}$)=$2.7\times10^{-3}$ ($\mathrm{cm^3\cdot sec^{-1}}$).

The volumetric evaporation amount of the electron beam irradiating portion 1*a* of the rotating anticathode 1 can be represented by the following equation:

circumferential length of rotating anticathode (cm)× beam width of electron beam (cm)×depressing depth of rotating anticathode per second (cm) (2)

Therefore, if the circumferential length of the rotating anticathode 1 is set to 10Π cm and the beam width of the electron beam 30 is set to 0.08 cm, the equation (2) can be calculated as 10Π×0.08×d and the relation of 10Π×0.08×d=$2.7\times10^{-3}$ can be satisfied, the depressing depth d of the rotating anticathode 1 per second can be calculated as d=10.7 $\mu\mathrm{m\cdot sec^{-1}}$.

Generally, since the thickness of the rotating anticathode 1 is about 2 mm, if the above-described relation (i.e., d=10.7 $\mu\mathrm{m\cdot sec^{-1}}$) is satisfied, the rotating anticathode 1 is consumed so that some holes may be formed at the rotating anticathode 1 for about three minutes. On the other hand, the electron beam irradiating portion 1*a* is depressed by the irradiation of the electron beam 30 so that the intended X-ray is taken out of the depressed portion of the electron beam irradiating portion 1*a*. If the taking-out angle of the intended X-ray is six degrees, for example, the intended X-ray cannot be taken out of the electron beam irradiating portion 1*a* when the depth of the depressed portion becomes 63 μm. As a result, the intended X-ray cannot be taken out after the X-ray generating apparatus in this embodiment is operated for about six seconds.

If the vapor pressure p at equilibrium state is set to 0.1 Torr as the lower limited value thereof, the intended X-ray cannot be taken out after the X-ray generating apparatus in this embodiment is operated for about ten minutes by conducting the above-described calculation in the same manner.

Namely, according to the theoretical equations disclosed in conventional documents, it is considered that the X-ray generating apparatus disclosed in FIGS. 1 and 2 can be operated only for six seconds to ten minutes and thus, not operated for a long time. As a result, it is considered that even in the case that the X-ray generating apparatus (rotating anticathode X-ray generating apparatus) illustrated in FIGS. 1 and 2 is employed, it is difficult to stably generate an X-ray with high brightness for a long time.

However, even though the X-ray generating apparatus illustrated in FIGS. 1 and 2 is operated in the same manner as described above while the vapor pressure at equilibrium state of the electron beam irradiating portion 1*a* is set to 0.1 Torr or more, amazingly, the X-ray generating apparatus can be stably operated for several days and the intended X-ray with high brightness can be generated for the same period of time as the operating time. At present, in the case that the rotating anticathode 1 with a radius of 5 cm is made of Cu, the X-ray with a brightness of about 130 $\mathrm{kW/mm^2}$ is generated for 20 hours. The intensity of the X-ray is not declined over 20 hours so that the X-ray generating apparatus illustrated in FIGS. 1 and 2 can exhibit a lifetime several through several hundred times as long as the theoretical lifetime as described above.

Here, the same effect/function can be exhibited when the rotating anticathode 1 is made of another target material such as Co, Mo and W except Cu.

The electron beam irradiating portion 1*a* is kept against the cylindrical portion 11, that is, the rotating anticathode 1 by the centrifugal force generated in the direction outward from the cylindrical portion 11 and generated by the rotation of the rotating shaft 13.

Since the electron beam 30 is employed as an energy beam for heating the rotating anticathode 1, the intensity of the electron beam 30 (energy beam) to be irradiated per target unit area can be easily increased so as to easily generate the intended X-ray with high brightness.

Moreover, it is desired that the rotating anticathode 1 is rotated at a rotation rate within a range of 6000 rpm to 9000 rpm. In this case, the above-described effect/function can be exhibited effectively, but the reason is not clarified.

Figure 3:
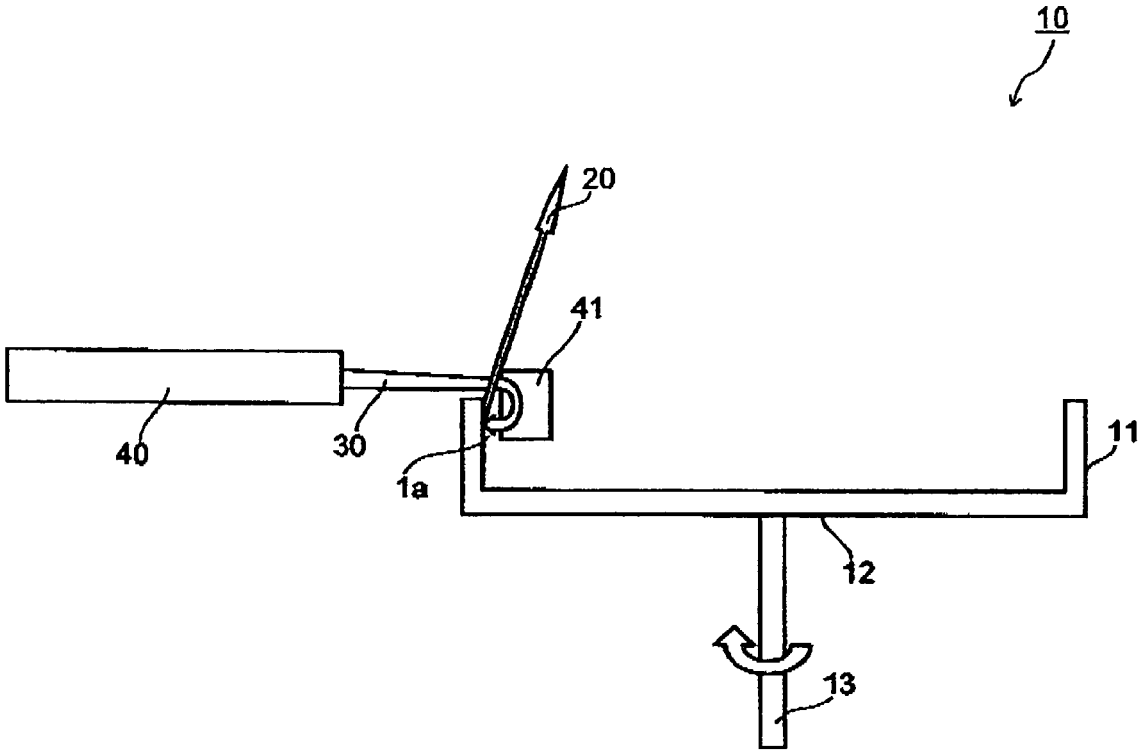
FIG. 3 is a structural view illustrating an X-ray generating apparatus according to another embodiment of the present invention.

FIG. 3 is a structural view illustrating an X-ray generating apparatus according to another embodiment of the present invention. In the X-ray generating apparatus illustrated in FIGS. 1 and 2, the anticathode chamber 2 for accommodating the rotating anticathode 1 is separated from the cathode chamber 4 for accommodating the cathode 3 so that the electron beam 30 is introduced linearly into the anticathode chamber 2 from the cathode 3 via the small hole 2*c* formed at the separating wall 2*b* for separating the anticathode chamber 2 and the cathode chamber 4, and then, irradiated onto the cylindrical portion 11 of the rotating anticathode 1.

On the contrary, in the X-ray generating apparatus in this embodiment, the rotating anticathode 1 and an electron beam source (cathode) are disposed in the same chamber, not disposed in the respective different chambers as the X-ray generating apparatus illustrated in FIGS. 1 and 2 so that an electron beam emitted from the electron beam source is deflected by a bending magnet and thus, irradiated onto the cylindrical portion 11 of the rotating anticathode 1. Hereinafter, this embodiment will be described concretely.

As shown in FIG. 3, the X-ray generating apparatus in this embodiment includes the rotating anticathode 1 and an electron gun 40 as the electron beam source. The rotating anticathode 1 includes the cylindrical portion 11 made of Cu (copper)or the like, the circular plate 12 formed so as to close the one opening of the cylindrical portion 11, and the rotating shaft 13 with a center shaft shared with the cylindrical portion 11 and the circular plate 12 which are integrally formed. The interiors of the cylindrical portion 11, the circular plate 12 and the rotating shaft 13 are formed in air hole so that a cooling water can be flowed in the interiors thereof in the same manner as described in FIGS. 1 and 2.

In this embodiment, the electron beam irradiating portion 1*a* is formed at the inner wall of the cylindrical portion 11.

As shown in FIG. 3, the X-ray generating apparatus in this embodiment is configured such that the rotating anticathode 1 and the electron gun 40 are disposed in the same chamber and the electron beam 30 emitted from the electron gun 40 is deflected by the bending magnet, concretely, the bending electron lens 40 so as to be irradiated onto the cylindrical portion 11 of the rotating anticathode 1. Therefore, the structure of the X-ray generating apparatus in this embodiment can be simplified in comparison with the X-ray generating apparatus 10 illustrated in FIGS. 1 and 2 where the anticathode chamber 2 for accommodating the rotating anticathode 1 and the cathode chamber 4 for accommodating the cathode 3 are separated from one another.

The electron beam 30 is laterally emitted from the electron gun 40 and deflected by about 180 degrees with the bending electron lens 41 so as to be irradiated onto the inner wall of the cylindrical portion 11 of the rotating anticathode 1, thereby generating the intended X-ray 20 from the heated electron beam irradiating portion 1*a*.

In this embodiment, the vapor pressure at equilibrium state of the electron beam irradiating portion 1*a* of the cylindrical portion 11 of the rotating anticathode 1 is set to 0.1 Torr or more, preferably 100 Torr or less, more preferably 10 Torr or less when the electron beam 30 is irradiated onto the electron beam irradiating portion 1*a*. In this case, the intended X-ray with high brightness can be generated for a long time while the consumption of the rotating anticathode 1 is prevented, but the reason is not found out and clarified.

The electron beam irradiating portion 1*a* is kept against the cylindrical portion 11, that is, the rotating anticathode 1 by the centrifugal force generated in the direction outward from the cylindrical portion 11 and generated by the rotation of the rotating shaft 13.

Although the present invention was described in detail with reference to the above examples, this invention is not limited to the above disclosure and every kind of variation and modification may be made without departing from the scope of the present invention.

For example, if the electron beam irradiating portion 1*a* is made of a target material commensurate with the intended X-ray and the surrounding area is made of a material with high melting point and/or high thermal conductivity, the cooling efficiency of the rotating anticathode 1 can be enhanced and the deformation of the rotating anticathode 1 can be prevented so that the brightness of the intended X-ray can be much enhanced.

Moreover, it is desired to prepare an exchangeable X-ray translucent protective film in front of the X-ray translucent film 22 of the anticathode chamber 2 so as not to contaminate the X-ray translucent film 22 with the constituent components vaporized from the electron beam irradiating portion 1*a* of the rotating anticathode 1. In this case, a supply roll with a long and rolled protective film made of a material having recoil electron-resistance such as Ni and a wind-up roll for winding up the protective film rolled at the supply roll are prepared in the inside of the X-ray window 21 so that the protective film stretched between the supply roll and the wind-up roll are disposed in front of the X-ray translucent film 22.

What is claimed is:

1. A method for generating an X-ray, comprising the steps of:

irradiating an energy beam onto a rotating anticathode so as to heat a portion irradiated by the energy beam under a condition that a vapor pressure at equilibrium state of the portion is set to 0.1 Torr or more, thereby generating an X-ray; and affecting a centrifugal force to the portion in a direction outward from a surface of the portion so as to keep the portion at the rotating anticathode.

2. The generating method as set forth in claim 1, wherein the vapor pressure at equilibrium state is set to 100 Torr or less.

3. The generating method as set forth in claim 2, wherein the vapor pressure at equilibrium state is set to 10 Torr or less.

4. The generating method as set forth in claim 1, wherein the rotating anticathode includes a cylindrical portion with a central axis corresponding to a rotation center of the rotating anticathode so that the energy beam is irradiated onto an inner wall of the cylindrical portion.

5. The generating method as set forth in claim 1, wherein a rotation rate of the rotating anticathode is set within a range of 6000 rpm to 9000 rpm.

6. The generating method as set forth in claim 1, wherein the energy beam is an electron beam.

7. An apparatus for generating an X-ray, comprising:

an energy beam source for generating an energy beam;

a rotating anticathode for generating an X-ray by an irradiation of the energy beam from the energy beam source; and a rotation mechanism, connected with the rotating anticathode, for affecting a centrifugal force in a direction outward from the rotating anticathode, wherein the energy beam is irradiated so as to heat a portion irradiated by the energy beam under a condition that a vapor pressure at equilibrium state of the portion is set to 0.1 Torr or more; and wherein the portion is kept at the rotating anticathode by the centrifugal force.

8. The generating apparatus as set forth in claim 7, wherein the vapor pressure at equilibrium state is set to 100 Torr or less.

9. The generating apparatus as set forth in claim 8, wherein the vapor pressure at equilibrium state is set to 10 Torr or less.

10. The generating apparatus as set forth in claim 7, wherein the rotating anticathode includes a cylindrical portion with a central axis corresponding to a rotation center of the rotating anticathode so that the energy beam is irradiated onto an inner wall of the cylindrical portion.

11. The generating apparatus as set forth in claim 7, wherein a rotation rate of the rotating anticathode is set within a range of 6000 rpm to 9000 rpm.

12. The generating apparatus as set forth in claim 7, wherein the energy beam is an electron beam.

* * * * *